US008381661B2

(12) United States Patent
Hilde

(10) Patent No.: US 8,381,661 B2
(45) Date of Patent: Feb. 26, 2013

(54) CONCEALABLE, AESTHETIC TRAY UNIT

(76) Inventor: Johanna Hilde, Everett, WA (US)

( * ) Notice: Subject to any disclaimer, the term of this patent is extended or adjusted under 35 U.S.C. 154(b) by 99 days.

(21) Appl. No.: 12/557,800

(22) Filed: Sep. 11, 2009

(65) Prior Publication Data

US 2011/0061571 A1 Mar. 17, 2011

(51) Int. Cl.
*A47B 23/00* (2006.01)

(52) U.S. Cl. ..... 108/42; 40/611.06; 108/48

(58) Field of Classification Search ..... 108/42, 108/44, 152, 33, 35, 38; 312/245, 315, 281, 312/282, 313; 40/152, 611.06, 311.1, 618, 40/709, 718, 723, 724, 765, 491, 727, 766, 40/611.1

See application file for complete search history.

(56) References Cited

U.S. PATENT DOCUMENTS 279,290 A * 6/1883 Wulbeke ..... 108/48
2,550,762 A * 5/1951 Bockus ..... 40/727
3,659,365 A * 5/1972 Eaton ..... 40/611.06
3,697,363 A * 10/1972 Martinez ..... 428/67
4,261,122 A * 4/1981 LeVine ..... 312/245
4,909,158 A * 3/1990 Sorensen ..... 108/40
5,408,936 A * 4/1995 Tseng ..... 108/42
5,713,146 A * 2/1998 Reeves, Sr. ..... 40/611.06
5,787,625 A * 8/1998 Yesbick ..... 40/718
6,039,416 A * 3/2000 Lambert ..... 108/48
6,053,585 A * 4/2000 Osen ..... 40/611.06
6,308,641 B1 * 10/2001 Kingbury ..... 108/42
6,553,704 B1 * 4/2003 Pigg ..... 40/721
6,658,677 B2 * 12/2003 Paul ..... 5/280
7,207,129 B2 * 4/2007 Buchanan et al. ..... 40/611.06
7,387,151 B1 * 6/2008 Payne ..... 312/204
7,481,014 B2 * 1/2009 Milburn ..... 312/245

* cited by examiner

*Primary Examiner* — Jose V Chen
(74) *Attorney, Agent, or Firm* — Richard C. Vershave; Foster Pepper PLLC

(57) ABSTRACT

A multipurpose rotatable tray includes a wall-mountable member rotationally coupled to a tray member, the latter being dually functional as (1) a horizontal support surface and (2) a wall hanging for an aesthetic article, while the tray member is in horizontal and vertical configurations, respectively. The tray member includes an opening for receiving a replaceable aesthetic article, such as, but not limited to, a painting or photograph. The tray unit may be automatically or manually coupled to the wall-mountable member when in the vertical configuration.

9 Claims, 3 Drawing Sheets

CONCEALABLE, AESTHETIC TRAY UNIT

FIELD OF THE INVENTION

This invention relates generally to a concealable, aesthetic tray unit, and specifically relates to a multipurpose tray unit rotatable relative to a vertical surface.

BACKGROUND OF THE INVENTION

Space constrained rooms are common in many households. Such rooms may include bathrooms, laundry rooms, closets, pantries, etc. The bathroom, for example, is typically one of the smallest rooms yet busiest rooms in the house, especially during the morning when occupants are starting their day. Various types of appliances have been designed or configured to provide for more bathroom space such as, but not limited to, pedestal sinks and medicine cabinets. The latter provides additional storage space in the bathroom, but is often aesthetically unappealing or merely doubles as a mirror. As families grow in terms of both size and age, the efficient usage of space in such traditionally space-constrained rooms becomes more important.

SUMMARY OF THE INVENTION

The present invention relates to a space saving, aesthetic tray unit, and specifically relates to a multipurpose tray unit rotatable relative to a vertical surface. The tray unit may have a viewable portion and a wall-facing portion. The viewable portion may take the form of a transparent cover situated in a channel of a picture or artwork frame.

In accordance with an aspect of the invention, a concealable tray system includes a wall-mountable member; a tray member configured to receive a replaceable aesthetic member, the tray member hingedly coupled to the wall-mountable member, the tray member having a wall-facing surface and a viewable surface, the wall facing surface engagable with the wall-mountable member when the tray member is in a substantially vertical configuration and further operable as a support surface when in a substantially horizontal configuration; and a hinge bracket having a first end attached to the wall-mountable member and a second end attached to the tray member, the hinged bracket movable to an extended position to provide a structural load path between the tray member and the wall-mountable member.

In accordance with another aspect of the invention, a method of installing a concealable tray system includes the steps of (1) attaching a wall-mountable member to a vertical surface; (2) hingedly coupling a tray unit to the wall-mountable member; and (3) placing a removable aesthetic member into an opening formed in the tray unit, the aesthetic member viewable when the tray unit is in a stowed configuration.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

As will be described in further detail below, at least one embodiment of the invention includes a concealable tray unit for efficiently utilizing space and providing an aesthetic wall hanging within a small room. By way of example, the tray unit may be multipurpose in that in a vertical or stored configuration its first purpose is to operate as a cabinet for discreetly storing medicine, hygiene items, and/or other items. Its second purpose, still while in the vertical configuration, is to operate as an aesthetic wall hanging, thus concealing that the unit is a cabinet even while in plain sight. Yet a third purpose, when the unit is in a horizontal or functional configuration, is to function as a tray to support items, such as hygiene or grooming items in a bathroom, etc. The multipurpose tray unit may include a wall-mountable member rotationally coupled to a tray member, the latter being dually functional as a tray and a frame for an aesthetic article while in the open and closed configurations, respectively.

Figure 1:
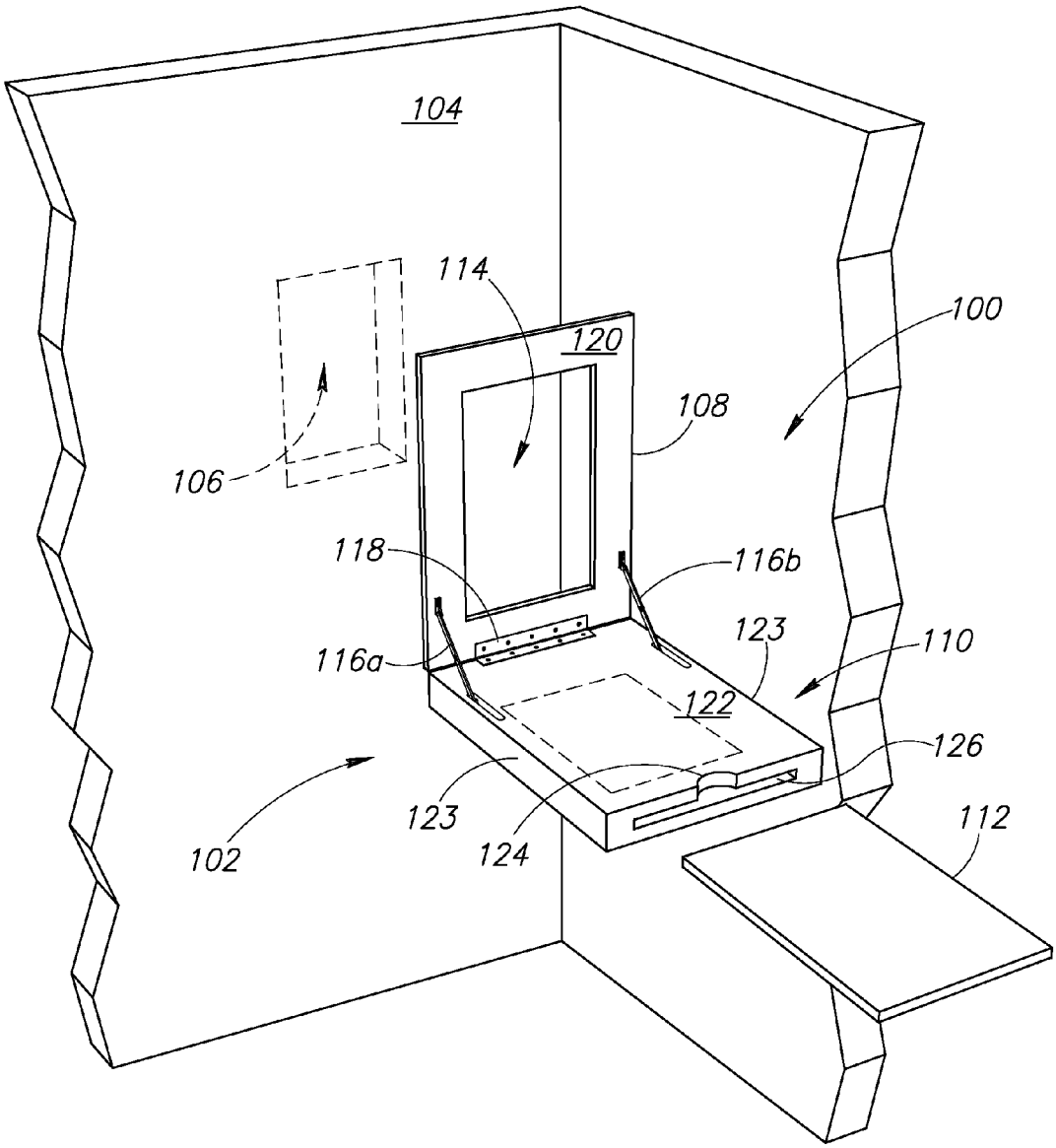
FIG. 1 is perspective view of a concealable tray system with a tray member in a substantially horizontal configuration according to an embodiment of the present invention.

FIG. 1 shows a concealable tray unit installation 100 that includes a tray unit assembly 102 attached to a wall 104, which may optionally include a storage opening or recess 106. The wall 104 may take the form of practically any vertical structure capable of supporting the weight of the tray unit assembly 102. By way of example, the wall 104 may be located in a bathroom, laundry room, closet, pantry, garage, office or some other room within a building. The optional storage recess 106 may separately roughed into the wall 104 with a depth and configuration similar to or larger than a conventional medicine cabinet. Shelves (not shown) may be used within the optional storage recess 106 to provide horizontal surfaces for storing various items.

The tray unit assembly 102 includes a wall-mountable member 108 hingedly coupled to a rotatable tray 110. An aesthetic article 112 may be inserted into a slot 114 of the rotatable tray 110 or inserted by into the back of the rotatable tray 110 by conventional frame insertion means as best illustrated by the alternative embodiment shown in FIG. 4. In either embodiment, the rotatable tray 110 may be covered, waterproofed, or otherwise sealed to prevent seepage or ingression of a liquid that may be applied to the rotatable tray 110 when it is functioning as a tray to support items. Alternatively and briefly referring back to FIG. 1, the rotatable tray 110 may have a unitary construction (e.g., one-piece) as between at least the inward facing surface 122 and side surfaces 123. The aesthetic article 112 may take the form of a photograph, painting, artwork, decoration or essentially anything that could be received in the rotatable tray 110. Preferably, the aesthetic article 112 may take the form of a planar board or sheet, but may also have a three-dimensional surface.

Figure 4:
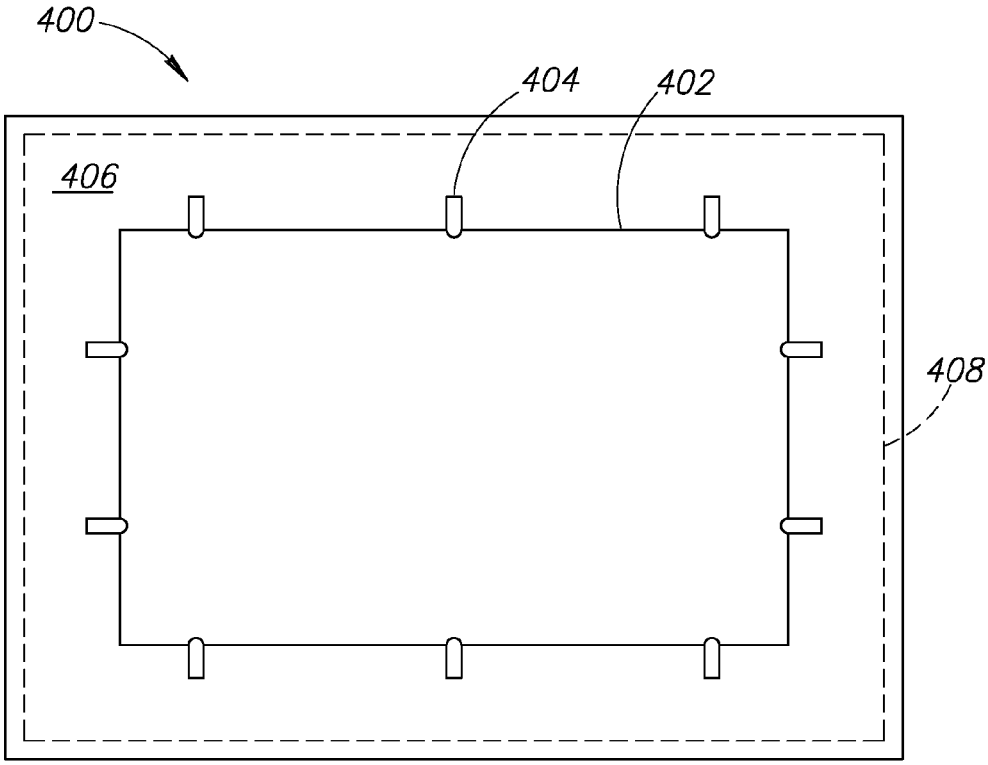
FIG. 4 is a top plan view of a backside of a tray member of a concealable tray system according to another embodiment of the present invention.

Referring briefly to FIG. 4, a rotatable tray 400 may include a backing member 402 with flexible tabs 404 for securing an aesthetic article (not shown) in the rotatable tray 400 from the back side 406 thereof. To prevent or at lease minimize the likelihood of damage to the aesthetic article from a liquid (not shown) applied on the rotatable tray 400, an optional cover or sealant 408 may be arranged over and secured to the rotatable tray 400.

Now referring back to the illustrated embodiment of FIG. 1, the wall-mountable member 108 takes the form of a frame with an opening 114 sized to provide access to the optional storage recess 106 in the wall 104. In another embodiment, the wall-mountable member 108 may be configured like a medicine cabinet to provide a stand-alone storage system, best illustrated in the embodiment of FIG. 2. The wall-mountable member 108 may be made from a variety of materials, such as, but not limited to, wood, plastic, wood-plastic composite, etc. The wall-mountable member 108 may be attached to the wall 104 by conventional means, which may include fasteners (e.g. dry wall fasteners), adhesive, or dowel pins. In one embodiment, the wall-mountable member 108 may have a tapered or variable thickness or may otherwise be reinforced to provide additional structural robustness in desired regions.

A number of hinge mechanisms 116*a*, 116*b*, 118 may be used to hingedly couple the wall-mountable member 108 to the rotatable tray 110. In the illustrated embodiment, the hinge mechanisms 116*a*, 116*b* take the form of lockable, folding hinges, such as hinges used to lock a ladder in an open or V-shaped position. Further, the hinge mechanisms 116*a*, 116*b* may be recessed or embedded in the wall-mountable member 108 and the rotatable tray 110, respectively, to permit a flush or abutting engagement between an outward-facing surface 120 of the wall-mountable member 108 and an inward-facing surface 122 of the rotatable tray 110. The hinge mechanism 118 may take the form of a continuous hinge, commonly referred to as a piano hinge. The hinge mechanism 118 provides structural stability and continuity between the wall-mountable member 108 and the rotatable tray 110 when the tray 110 is placed in a substantially horizontal or functional configuration as shown in FIG. 1.

The rotatable tray 110 may take the form of a picture or artwork frame. In one embodiment, the rotatable tray 110 includes a finger-sized recess 124 extending from the inward-facing surface 122 to provide access to the aesthetic article 112. In addition, the rotatable tray 110 includes a slot or channel 126 to receive the aesthetic article 112.

Figure 2:
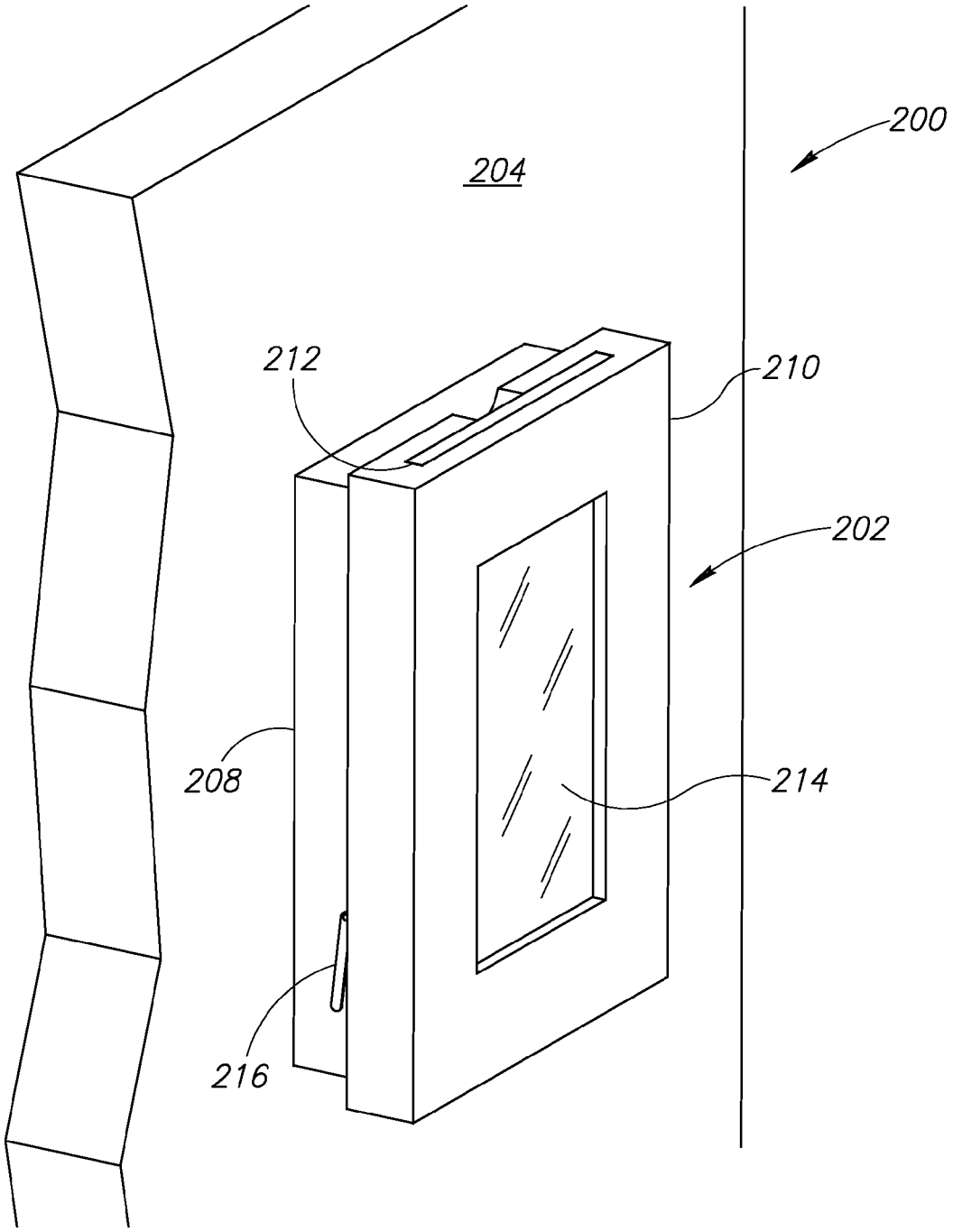
FIG. 2 is perspective view of a concealable tray system with a tray member in a substantially vertical or stored configuration according to an embodiment of the present invention.

FIG. 2 shows another embodiment of a concealable tray unit installation 200 that includes a tray unit assembly 202 attached to a wall 204 over a storage opening or recess (not shown). In the illustrated embodiment, the tray unit assembly 202 includes a wall-mountable member 208 hingedly coupled to a rotatable tray member 210, which in turn is positioned in a substantially vertical or stored configuration. The rotatable tray member 210 includes a slot 212 for receiving an aesthetic article, which is not illustrated, but would be viewable through a transparent cover or insert 214 retained in the rotatable tray member 210.

Figure 3:
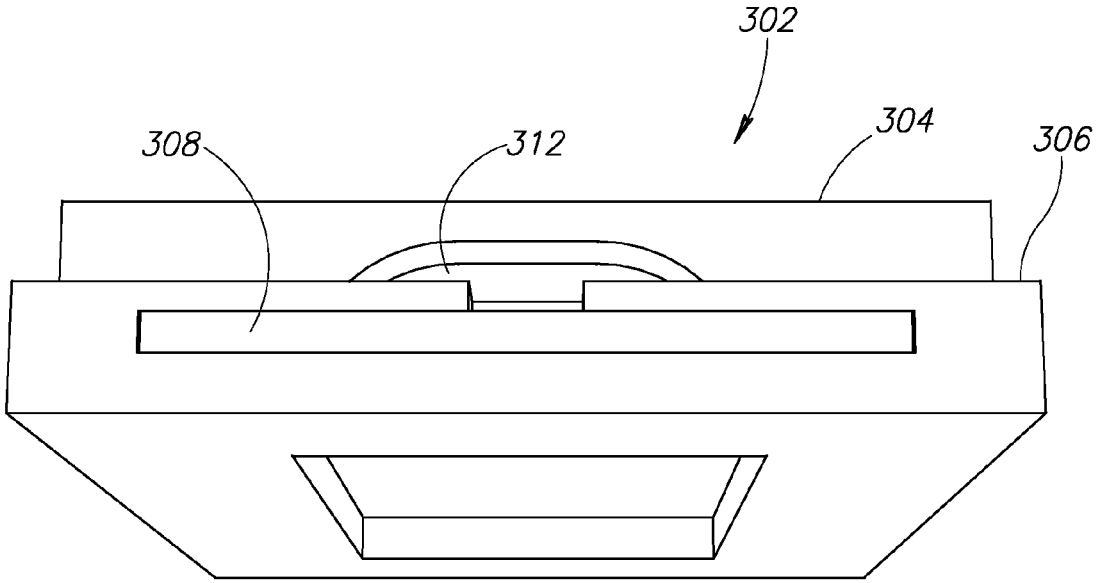
FIG. 3 is a top, elevational view of a concealable tray system according to an embodiment of the present invention.

FIG. 3 shows a tray unit assembly 302 having a wall-mountable member 304 coupled to a rotatable tray member 306. In the illustrated embodiment, the rotatable tray member 306 may be coupled to the wall-mountable member 304 such that it remains in a substantially vertical configuration. By way of example, the rotatable tray member 306 may be magnetically or mechanically latched to the wall-mountable member 304. In one embodiment, hook and loop fasteners, such as VELCRO® fasteners, may be used to maintain the wall-mountable member 304 in the vertical configuration.

In operation, the tray unit assemblies described above may be installed in space-constrained rooms, but could be installed in other rooms as well. The rotatable tray member may be rotated relative to the wall-mountable member to be in a substantially horizontal configuration making it usable as a platform for placing items, such as toiletries or folded clothes, etc. In one embodiment, the tray unit assembly may be mounted in a bathroom to provide extra counter space when in the horizontal configuration and then provide a means to display photographs, artwork or some other aesthetic item when in the vertical configuration.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A concealable tray system comprising:

a wall-mountable member;

a residential shelving member having a slot configured to receive a replaceable aesthetic member, the slot extending into the shelving member from a top portion of the shelving member, the slot arranged such that an inward-facing surface of the shelving member operates as a cover for the aesthetic member, the shelving member hingedly coupled to the wall-mountable member, the shelving member having the inward-facing surface, and an outward-facing surface and a plurality of edge surfaces, the inward-facing surface engagable with the wall-mountable member when the shelving member is in a substantially vertical configuration, the inward-facing surface operable as a support surface when the shelving member is in a substantially horizontal configuration, the inward-facing surface unitarily constructed with the plurality of edge surfaces to provide a sealed structure such that liquid placed on the inward-facing surface cannot damage the aesthetic member; and a hinge bracket having a first end attached to the wall-mountable member and a second end attached to the shelving member, the hinged bracket movable to an extended position to provide a structural load path between the shelving member and the wall-mountable member.

2. The concealable tray system of claim 1, wherein the wall-mountable member includes an opening that cooperates with a storage space formed in a wall.

3. The concealable tray system of claim 1, wherein the shelving member includes a slot sized to receive the aesthetic member.

4. The concealable tray system of claim 3, wherein the aesthetic member is a sheet having an image.

5. The concealable tray system of claim 4, wherein the image includes at least one photograph.

6. The concealable tray system of claim 1, wherein the shelving member includes a finger-sized groove configured to permit access to the aesthetic member when positioned in the shelving member.

7. The concealable tray system of claim 1, wherein the outward-facing surface includes a transparent material.

8. The concealable tray system of claim 1, wherein the hinge bracket is lockable to maintain the shelving member in the substantially horizontal configuration.

9. The concealable tray system of claim 1, wherein the inward-facing surface is a continuous surface operable as the support surface when in the substantially horizontal configuration.

* * * * *